US010104996B2

(12) United States Patent
Chen

(10) Patent No.: US 10,104,996 B2
(45) Date of Patent: Oct. 23, 2018

(54) CHOPSTICKS

(71) Applicant: Ming-Sung Chen, Taichung (TW)

(72) Inventor: Ming-Sung Chen, Taichung (TW)

( * ) Notice: Subject to any disclaimer, the term of this patent is extended or adjusted under 35 U.S.C. 154(b) by 292 days.

(21) Appl. No.: 15/223,386

(22) Filed: Jul. 29, 2016

(65) Prior Publication Data

US 2017/0049255 A1 Feb. 23, 2017

(30) Foreign Application Priority Data

Aug. 21, 2015 (TW) ..... 104127285 A

(51) Int. Cl.
*A47G 21/06* (2006.01)
*A47G 21/00* (2006.01)

(52) U.S. Cl.
CPC ..... *A47G 21/103* (2013.01); *A47G 2021/002* (2013.01)

(58) Field of Classification Search
CPC ..... A47G 21/103; A47G 2021/002; A47J 43/283
USPC ..... 294/218
See application file for complete search history.

(56) References Cited

U.S. PATENT DOCUMENTS 7,258,375 B1 * 8/2007 Shen ..... A47G 21/103 294/218
7,571,943 B1 * 8/2009 Lee ..... A47G 21/103 294/218
7,770,950 B1 * 8/2010 Liu ..... A47G 21/103 294/218
2006/0170229 A1 * 8/2006 Raeder ..... A47G 21/103 294/218
2007/0216176 A1 * 9/2007 Tsai ..... A47G 21/103 294/218
2008/0079274 A1 * 4/2008 Shen Ku ..... A47G 21/103 294/218
2008/0185853 A1 * 8/2008 Shen ..... A47G 21/103 294/218
2009/0121501 A1 * 5/2009 Liu ..... A47G 21/10 294/218
2010/0259054 A1 * 10/2010 Shen Ku ..... A47G 21/103 294/218

(Continued)

FOREIGN PATENT DOCUMENTS

CH 686336 A5 * 3/1996 ..... A47G 21/103
EP 1958547 A1 * 8/2008 ..... A47G 21/02
JP 3130500 U * 3/2007 ..... A47G 21/02

*Primary Examiner* — Gabriela M Puig
(74) *Attorney, Agent, or Firm* — Lynette Wylie; Apex Juris, pllc.

(57) ABSTRACT

A pair of chopsticks is disclosed, each of which includes a first body, a second body, and a locking member. The first body has at least one positioning slot, a storage space, and an opening communicating with the storage space. The second body can be completely or partly received in the storage space through the opening of the first body, wherein an outer wall of the second body has at least one protrusion which enters the positioning slot when the second body is in a predetermined position in the storage space. The locking member has a locking portion engaged with the first body, wherein the locking member is controllable to make the locking portion enter the positioning slot to prevent the protrusion therein from leaving the positioning slot whereby the chopsticks are retractable and more portable.

8 Claims, 12 Drawing Sheets

(56) References Cited

U.S. PATENT DOCUMENTS

2011/0042977 A1* 2/2011 Shen ..... A47G 21/103
294/218

* cited by examiner

CHOPSTICKS

BACKGROUND OF THE INVENTION

1. Technical Field

The present invention generally relates to chopsticks, and more particularly to a pair of retractable chopsticks.

2. Description of Related Art

Disposable tableware, especially disposable chopsticks, is widely used for its convenience and effect of preventing spreading contagious diseases. However, recent surveys on the sanitary quality of disposable chopsticks have shown that most of the disposable chopsticks contain chemical additives, and in certain cases, there are even heavy metals contained therein, which potentially harms the food safety.

Therefore, many people encourage consumers to carry chopsticks on their own to prevent ingesting the toxic substances contained in the disposable chopsticks. Furthermore, using reusable chopsticks also corresponds to the trend of environmental protection, which is considered more eco-friendly.

However, chopsticks are elongated, and therefore may not be convenient to carry around. If chopsticks could be more portable, there would be more people willing to carry chopsticks by themselves.

BRIEF SUMMARY OF THE INVENTION

In view of the reasons mentioned above, the primary objective of the present invention is to provide a pair of chopsticks, which is retractable and more portable.

The present invention provides a chopstick of a pair of chopsticks, wherein the chopstick includes a first body, a second body, and a locking member. The first body is elongated, and has a storage space inside, wherein an end of the first body has an opening communicating with the storage space. The first body has at least one positioning slot provided on a wall of the storage space thereof, each of which has a main slot section. The second body is elongated, and is completely or partly receivable in the storage space through the opening of the first body, wherein the second body has at least one protrusion provided on an outer wall thereof. The at least one protrusion enters the main slot section of the at least one positioning slot when the second body is at a first position in the storage space. The locking member has a locking portion, and is engaged with the first body, wherein the locking member is controllable to make the locking portion enter the main slot section of one of the at least one positioning slot to prevent one of the at least one protrusion therein from leaving said main slot section.

With the aforementioned design, the pair of chopsticks are more portable because of its retractability, for the second body could be completely or partially received in the storage space through the opening of the first body.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
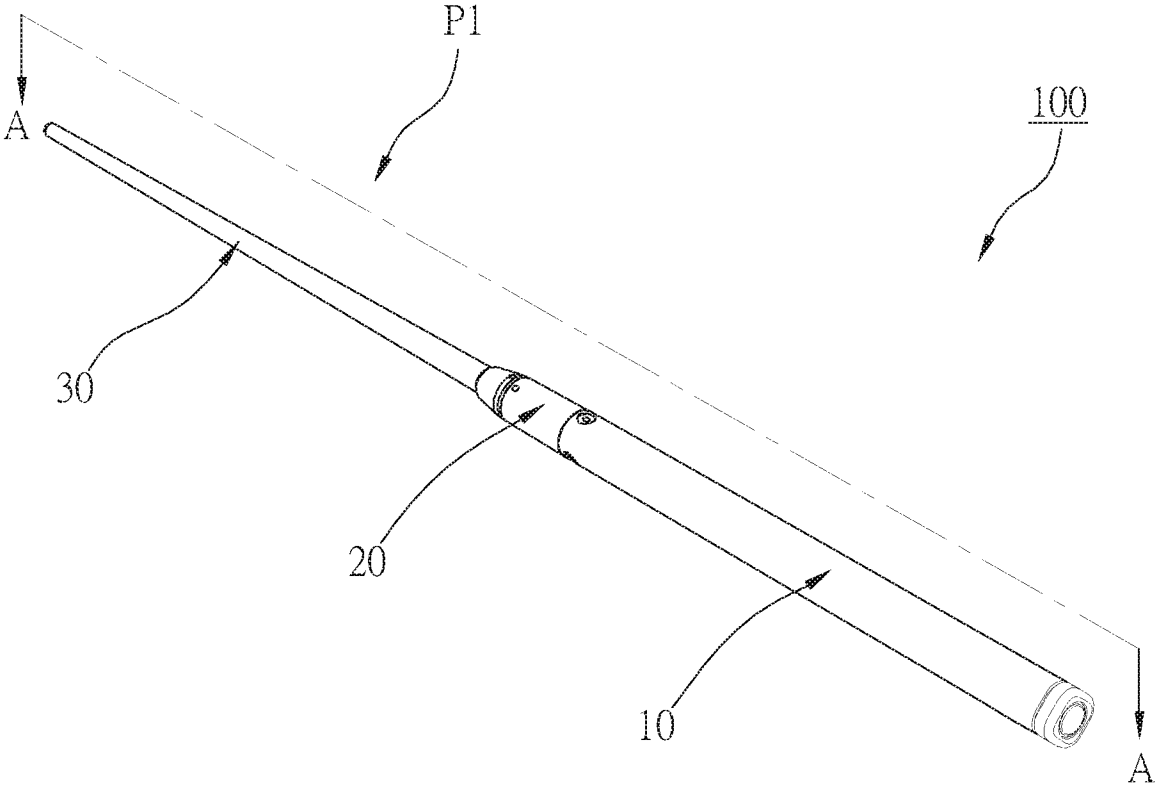
FIG. 1 is a perspective view of one chopstick in the pair of chopsticks of a first embodiment of the present invention.
Figure 2:
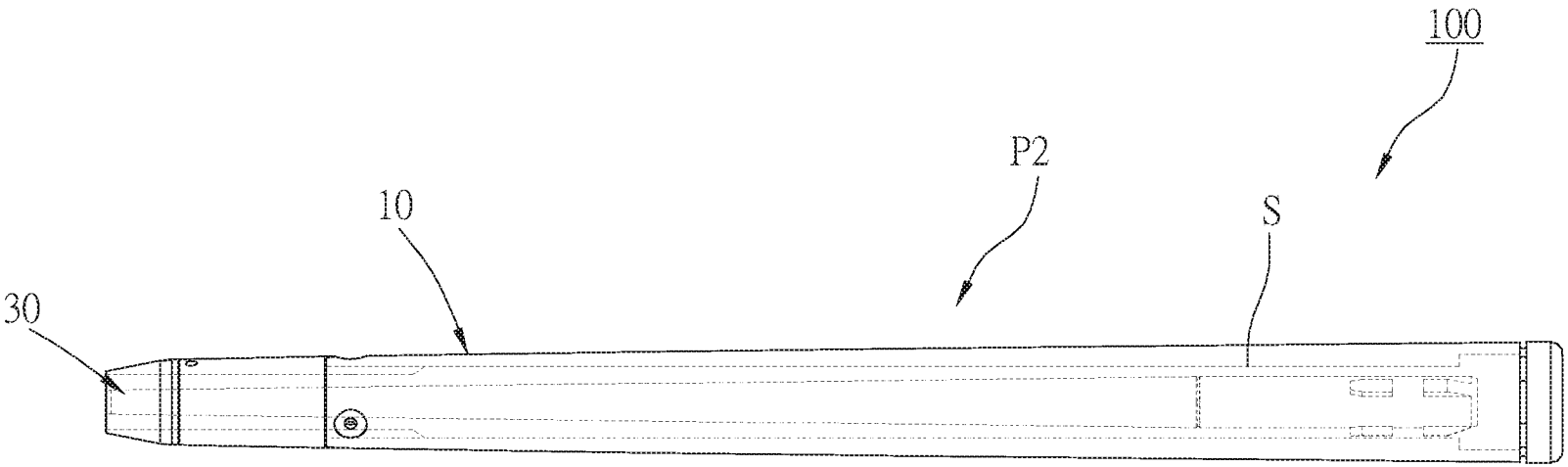
FIG. 2 is a schematic diagram, showing the chopstick shown in FIG. 1 in another state.
Figure 3:
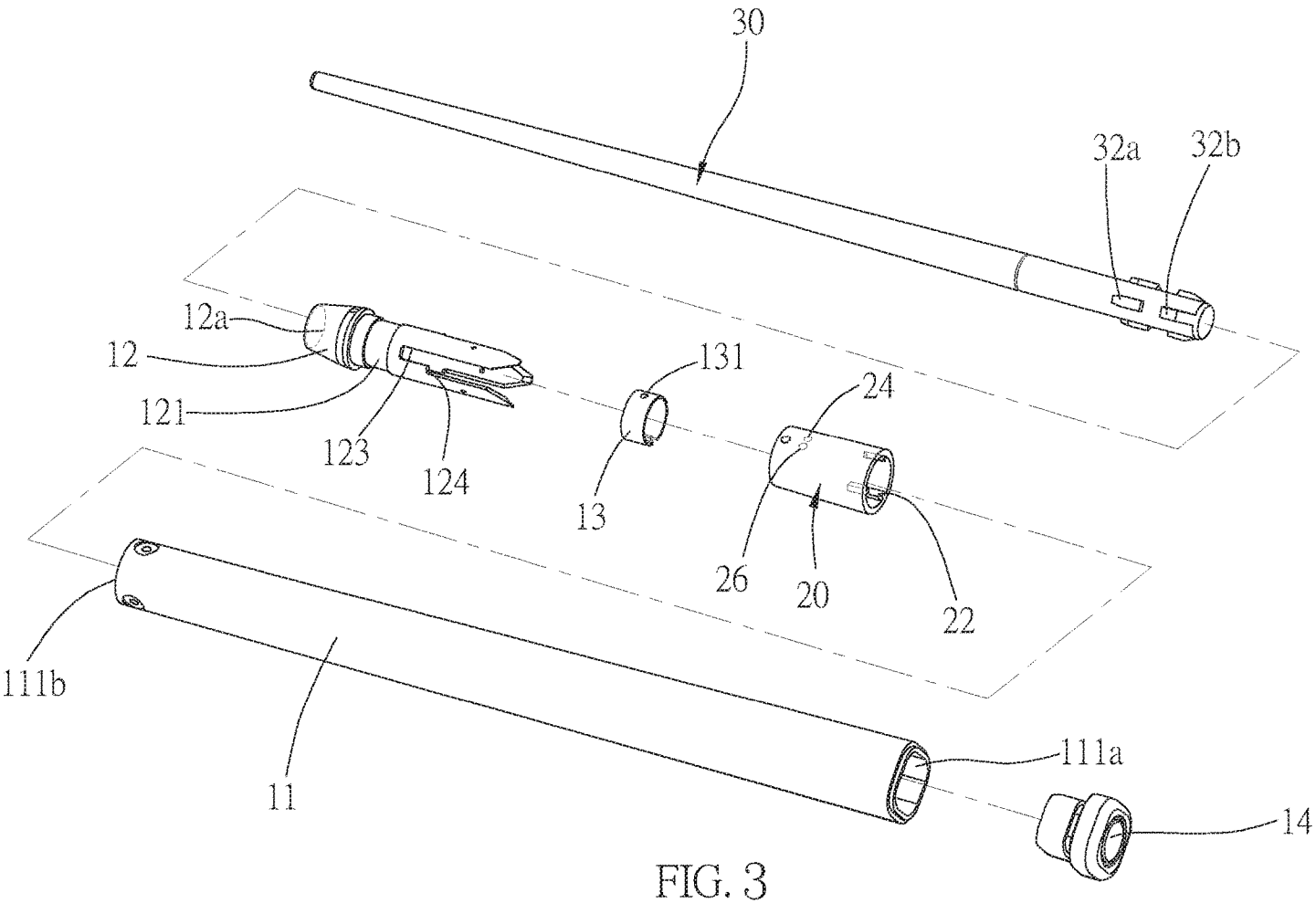
FIG. 3 is an exploded view of the chopstick shown in FIG. 1.

As shown in FIG. 1-3, one of a pair of chopsticks 100 of a first embodiment of the present invention includes a first body 10, a locking member 20, and a second body 30.

The first body 10 is elongated, and includes a stick 11, a securing member 12, a ring 13, and a cover 14.

The stick 11 is a polygonal tube. In the first embodiment, the stick 11 is a rectangular tube with four slightly curved corners, and two ends of the stick 11 have two openings 111*a*, 111*b*, which communicate an inner space of the stick 11 and outside.

As shown in FIG. 3, the securing member 12 is a short round tube, and has a circular groove 121, a bore 122 (shown in FIG. 7), an opening 12*a*, and three positioning slots, wherein the circular groove 121 is on an outer wall of the securing member 12; the bore 122 runs through the outer wall of the securing member 12 and a bottom of the circular groove 121; the opening 12*a* is located at one end of the securing member 12, and communicates with inside of the securing member 12. The three positioning slots are parallel to each other, and are arranged evenly on the outer wall, with regular intervals therebetween, wherein each of the positioning slots has an open end at another end of the securing member 12, and a width of each of the positioning slots increases gradually from a predetermined position near the open end to the open end. Each of the positioning slots has a main slot section 123 and a subsidiary slot section 124 which are arranged in parallel, and communicate with each other, wherein a length of each of the main slot sections 123 is greater than a length of each of the subsidiary slot sections 124.

Figure 4:
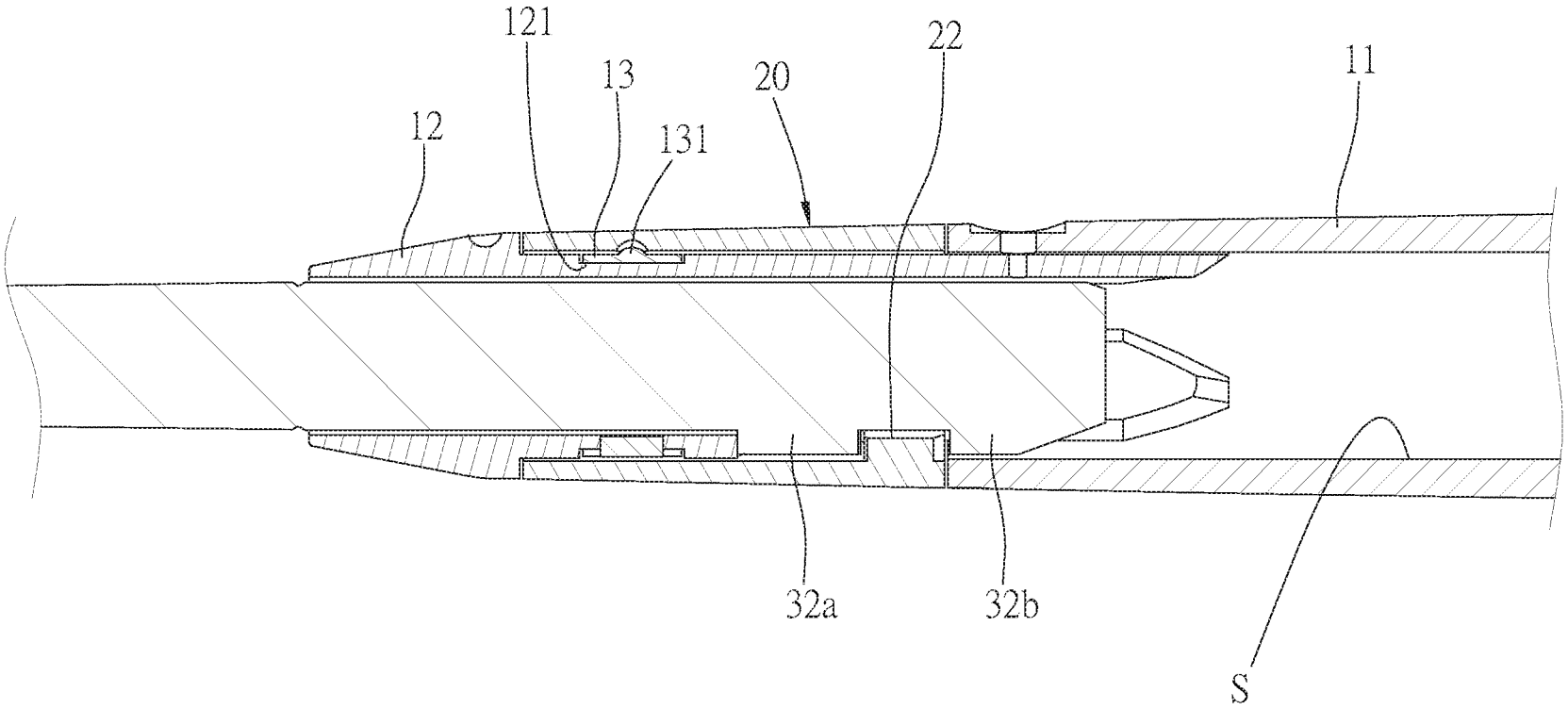
FIG. 4 is a sectional view along the A-A line in FIG. 1.
Figure 7:
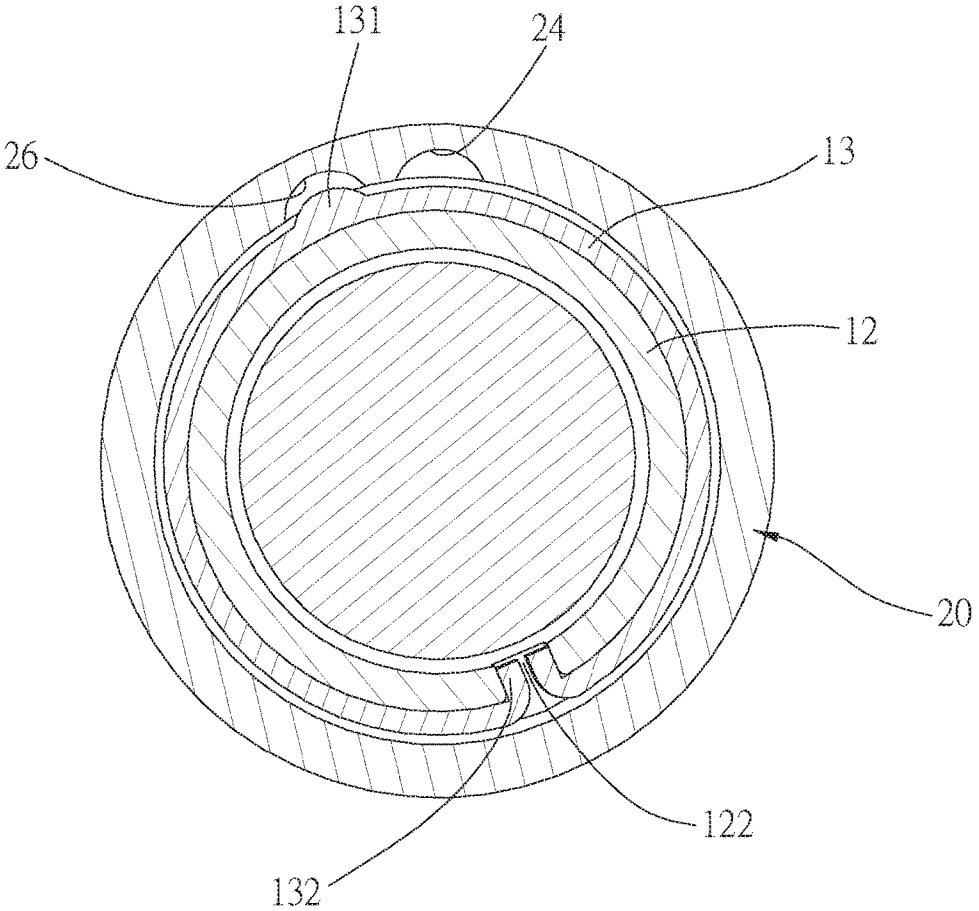
FIG. 7 is a sectional view along the B-B line in FIG. 6.

As shown in FIG. 4 and FIG. 7, the ring 13 is made of a metal sheet, and has a positioning protrusion 131. Each of two opposite ends of the ring 13 has a reversed section 132. The ring 13 is received in the circular groove 121 of the securing member 12, and the two reversed sections 132 thereof enter the bore 122 of the securing member 12 to be engaged with the securing member 12, whereby the ring 13 is not rotatable relative to the securing member 12.

The cover 14 is detachably engaged with the stick 11, and seals one of the openings 111*a*.

The locking member 20 is tubular, and fits around the securing member 12 in a way which makes the locking member 20 rotatable relative to the securing member 12.

Figure 5:
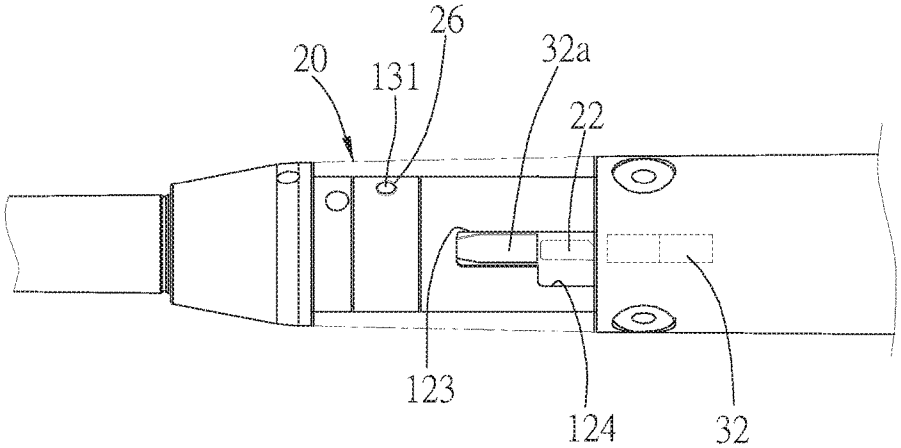
FIG. 5 is a schematic diagram, showing some components of the chopstick shown in FIG. 1 in a use condition.
Figure 6:
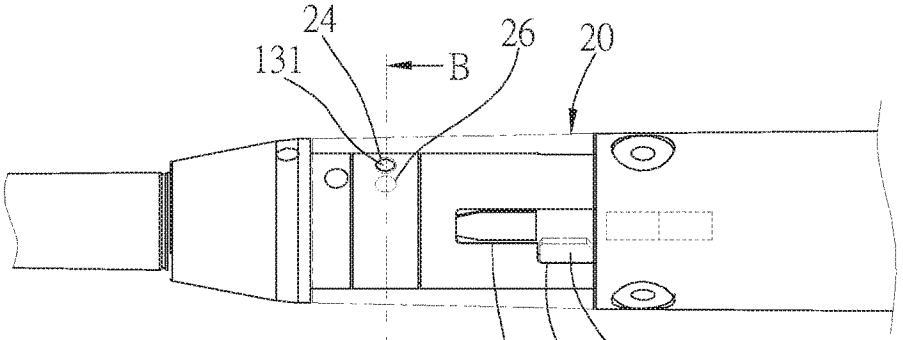
FIG. 6 is a schematic diagram, showing some components of the chopstick shown in FIG. 1 in another use condition.

The locking member 20 has three locking portions 22 and a positioning portion, wherein the three locking portions 22 are bulges bulging from an inner wall of the locking member 20, and each of the locking portions 22 is located respectively in one of the positioning slots. The locking member 20 is controllable to rotate on the securing member 12 to move each of the locking portions 22 between the main slot sections 123 or between the subsidiary slot sections 124 (as shown in FIG. 5 and FIG. 6).

In the first embodiment, the positioning portion has a first positioning hole 24 and a second positioning hole 26, which are on the inner wall of the locking member 20. While rotating the locking member 20, the positioning protrusion 131 of the securing member 12 could enter the first positioning hole 24 or the second positioning hole 26 of the locking member 20. In this way, the locking member 20 is restricted by the positioning protrusion 131, and consequently gets positioned, for the locking member 20 could not rotate relative to the first body 10 without being moved by an external force.

As shown in FIG. 4, the securing member 12 is engaged with one end of the stick 11, and the locking member 20 fits around the securing member 12. Part of the securing member 12 is received in the inner space of the stick 11, and the securing member 12 communicates with the inner space of the stick 11 to form a storage space S. Furthermore, the securing member 12 is engaged with the stick 11 through a plurality of screws (not shown).

The second body 30 is elongated, and could be made of plastic, wood, or metal, wherein, if the second body 30 is made of metal, the material could be selected from stainless steel or other anti-corrosive metal, such as silver. Alternatively, the second body 30 could also be made of common metal coated with an anti-corrosive layer. In the first embodiment, the second body 30 is made of common metal, which is coated with a silver layer to prevent corrosion or bacteria growth. The second body 30 is received in the first body 10, and could stretch out of the first body 10 through the opening 12*a* of the first body 10 to be positioned at a first position P1 on the first body 10 (as shown in FIG. 1). On the other hand, the second body 30 is positioned at a second position P2 on the first body 10 (as shown in FIG. 2) when completely received in the storage space S of the first body 10.

In the first embodiment, an outer wall of the second body 30 has three pairs of protrusions 32*a*, 32*b* near one end thereof, wherein the pairs of protrusions 32*a*, 32*b* correspond to the main slot sections 123 of the positioning slots. Furthermore, the pairs of protrusions 32*a*, 32*b* are arranged evenly along an axial direction of the second body 30, with regular intervals therebetween. The structure of the pair of chopsticks 100 of the present invention has been explained above, and the method of use the pair of chopsticks 100 is described below.

First, the pair of chopsticks 100 is ready to be used when the second body 30 is positioned at the first position P1. In this condition, the three pairs of protrusions 32*a*, 32*b* respectively enter the main slot sections 123 of the positioning slots, and the locking member 20 is rotatable to make the locking portions 22 get into the main slot sections 123, respectively. In this way, each of the locking portions 22 could be positioned between one of the pairs of the protrusions 32*a*, 32*b* to prevent each of the pairs of protrusions 32*a*, 32*b* from leaving the corresponding main slot section 123 (as shown in FIG. 5). In the meantime, the positioning protrusion 131 of the securing member 12 would be inserted into the second positioning hole 26 along with the rotation of the locking member 20, whereby the locking member 20 would be restricted by the positioning protrusion 131, and would not be rotatable without being moved by an external force. As a result, the second body 20 is located at the first position P1, with most of the second body 20 exposed out of the first body 10.

After using the pair of chopsticks 100, the locking member 20 could be forced to rotate, moving each of the locking portions 22 into one of the subsidiary slot sections 124 (as shown in FIG. 6). As a result, each pair of the protrusions 32*a*, 32*b* could leave the main slot sections 123 without being hindered. In the meantime, the positioning protrusion 131 would enter the first positioning hole 24 along with the rotation of the locking member 20 (as shown in FIG. 7), causing the locking member 20 to get positioned again.

In such a condition, each of the protrusions 32*a*, 32*b* of the second body 30 could be easily moved toward the first body 10 by an external force, and the second body 30 would be completely received in the storage space S of the first body 10. By simply remove the cover 14, the second body 20 could be taken out through the opening 111*a* to be cleaned.

In the aforementioned first embodiment, the cover 14 is detachably engaged with the stick 11 to form an end of the first body 10. With such design, the second body 30 could be conveniently taken out of the first body 10 to be cleaned. However, the stick 11 and the cover 14 could be also integrally made in other embodiments.

Figure 8:
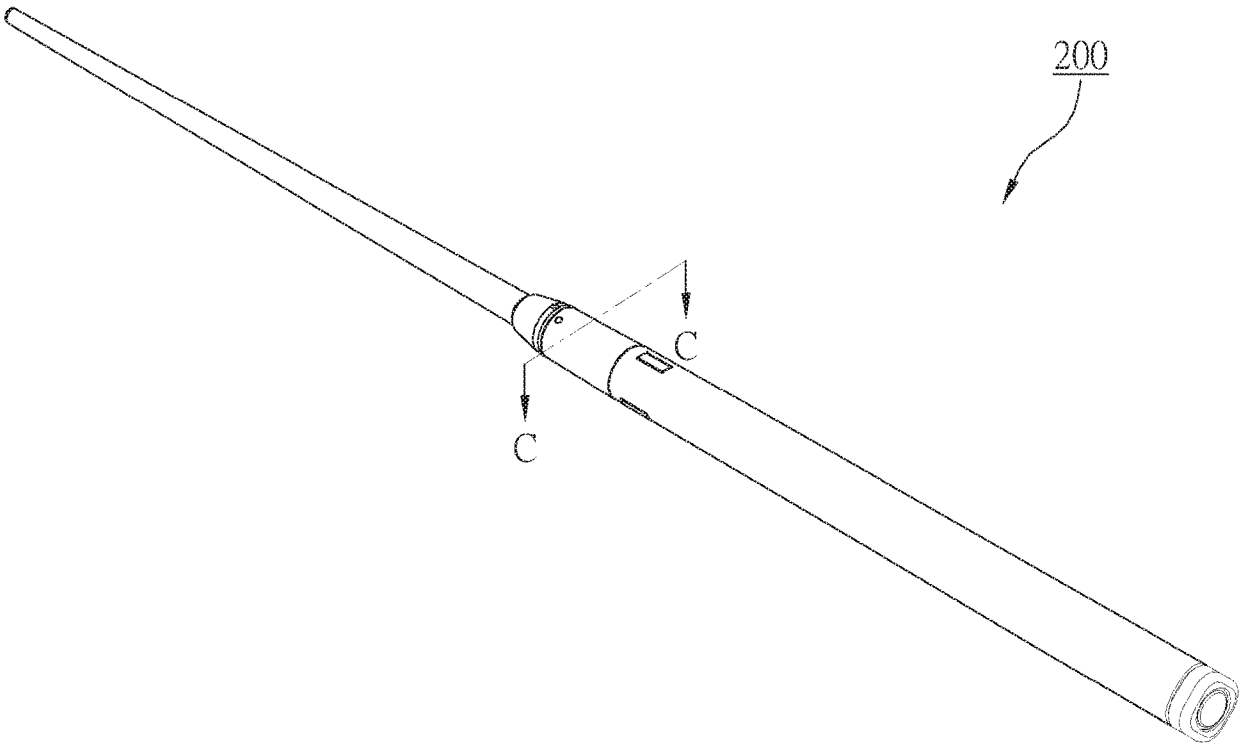
FIG. 8 is a perspective view of one chopstick in the pair of chopsticks of a second embodiment of the present invention.
Figure 9:
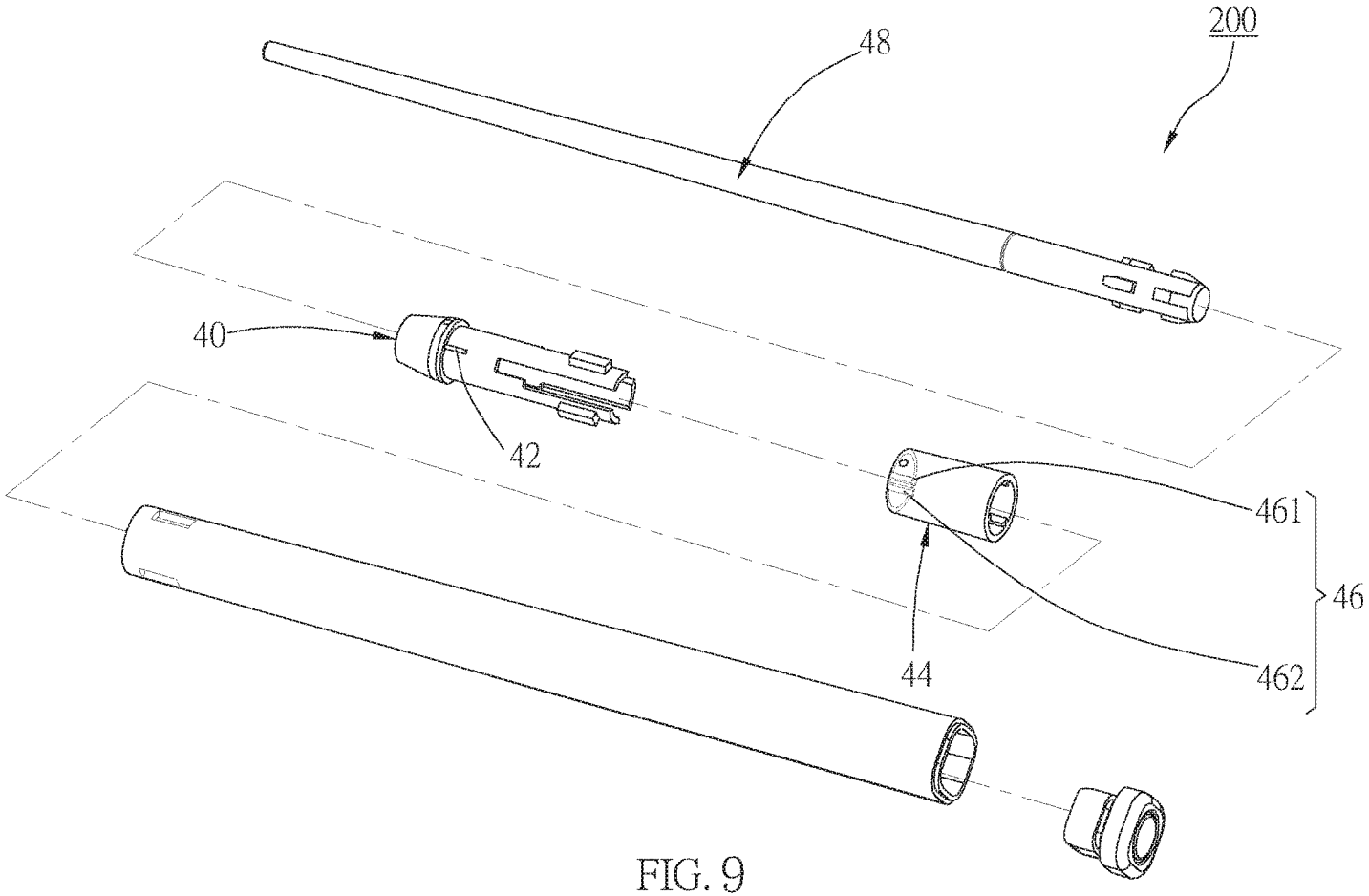
FIG. 9 is an exploded view of the chopstick shown in FIG. 8.
Figure 10:
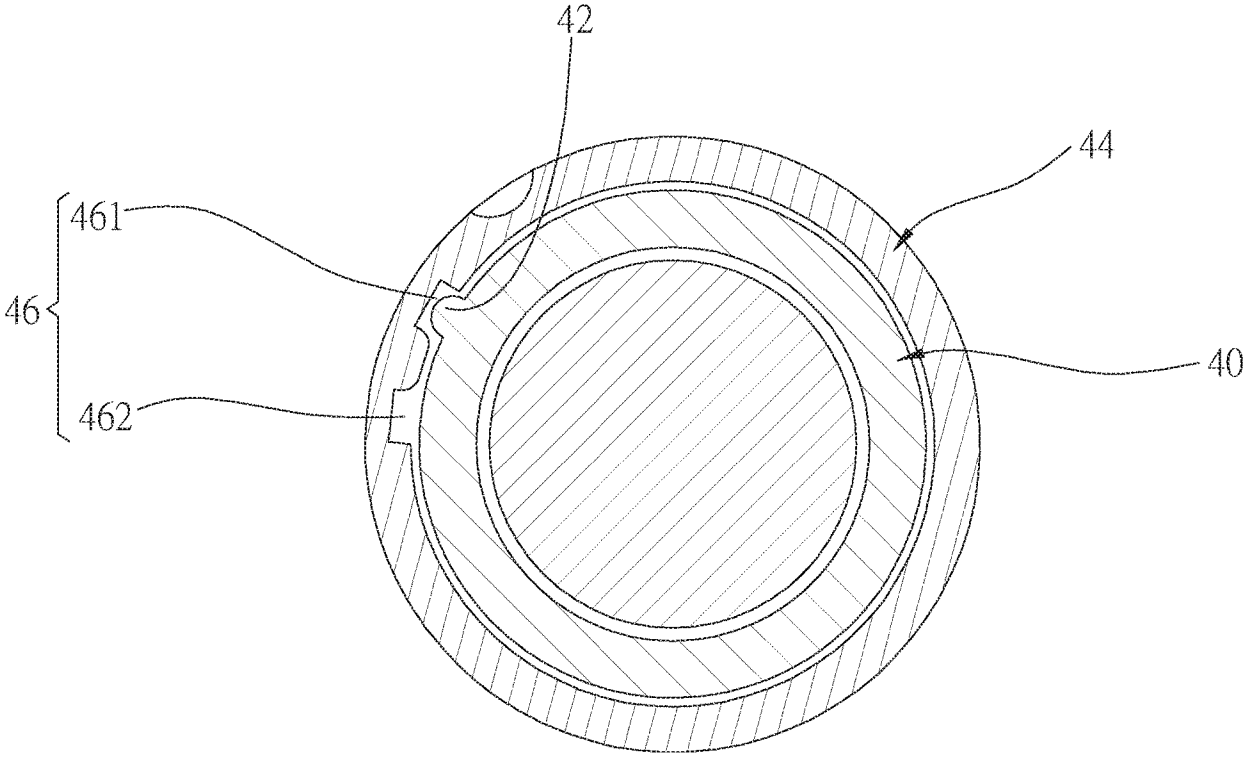
FIG. 10 is a sectional view along the C-C line in FIG. 8.

In addition to the aforementioned first embodiment, one of a pair of chopsticks 200 of a second embodiment of the present invention is illustrated in FIGS. 8-10. The difference between the chopsticks 200 of the second embodiment and the chopsticks 100 of the first embodiment is that, the chopsticks 200 do not have the ring mentioned in the first embodiment, and the structures of a securing member 40 and a locking member 44 are different from those in the first embodiment, too. The securing member 40 of the second embodiment has a positioning protrusion 42. The locking member 44 fits around the securing member 40, and has a positioning portion 46, which has a first slot body 461 and a second slot body 462 both recessed into an inner wall of the locking member 44. When the locking member 44 is rotated, the positioning protrusion 42 of the securing member 40 could enter the first slot body 461 or the second slot body 462 to fix the locking member 44, which indirectly keeps the second body 48 at different positions to achieve the retractable effect as mentioned in the first embodiment.

Figure 11:
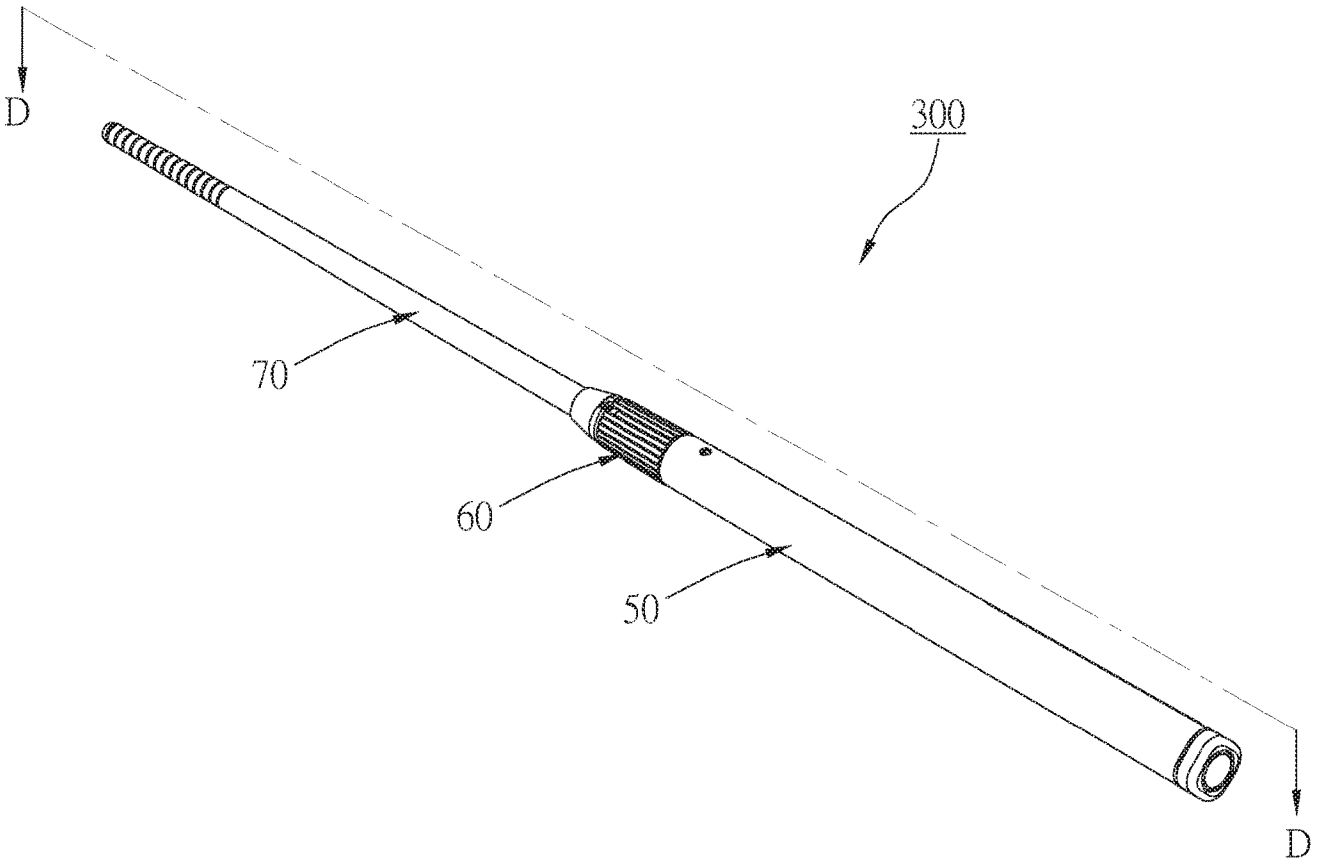
FIG. 11 is a perspective view of one chopstick in the pair of chopsticks of a third embodiment of the present invention.
Figure 12:
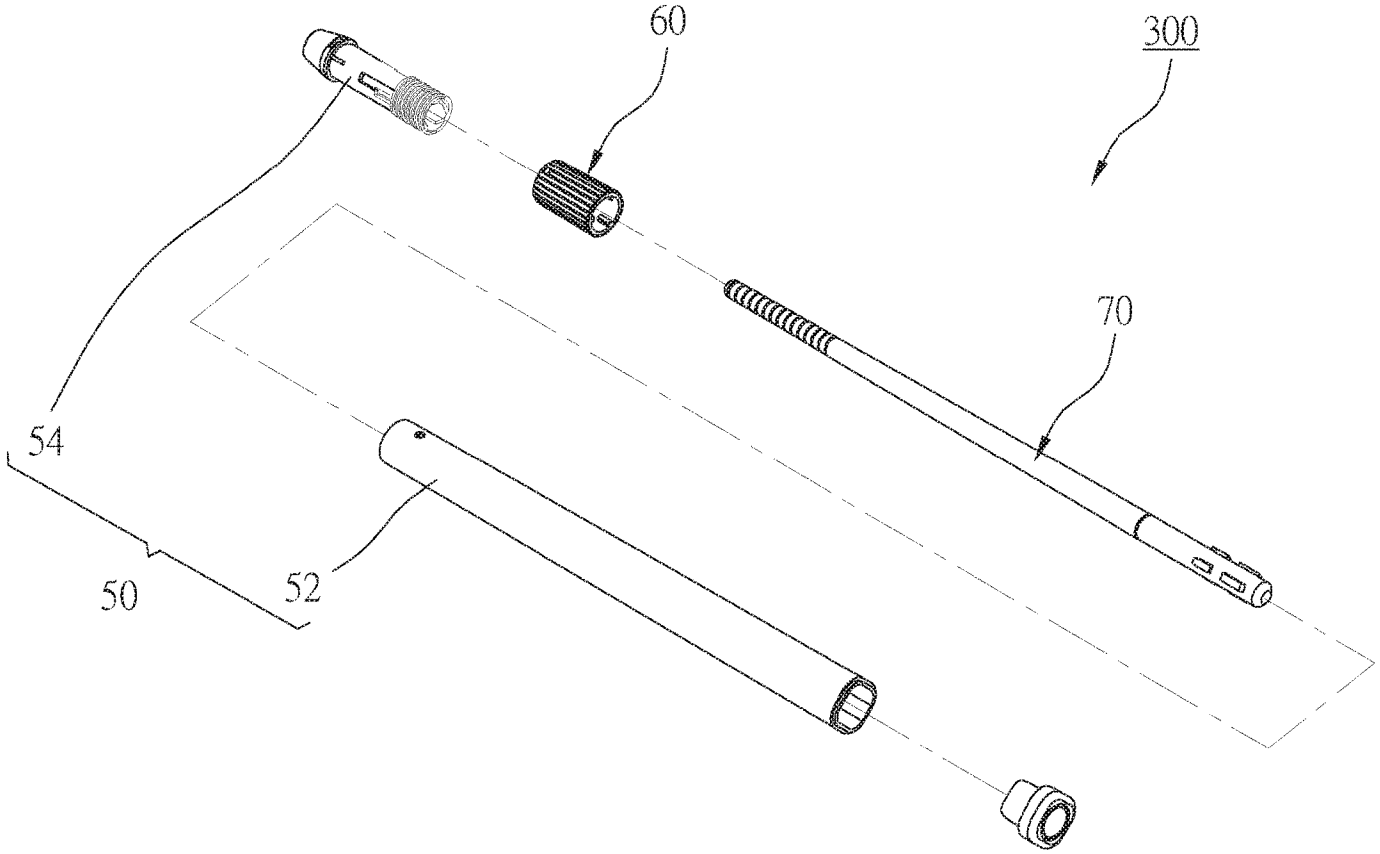
FIG. 12 is an exploded view of the chopstick shown in FIG. 11.
Figure 13:
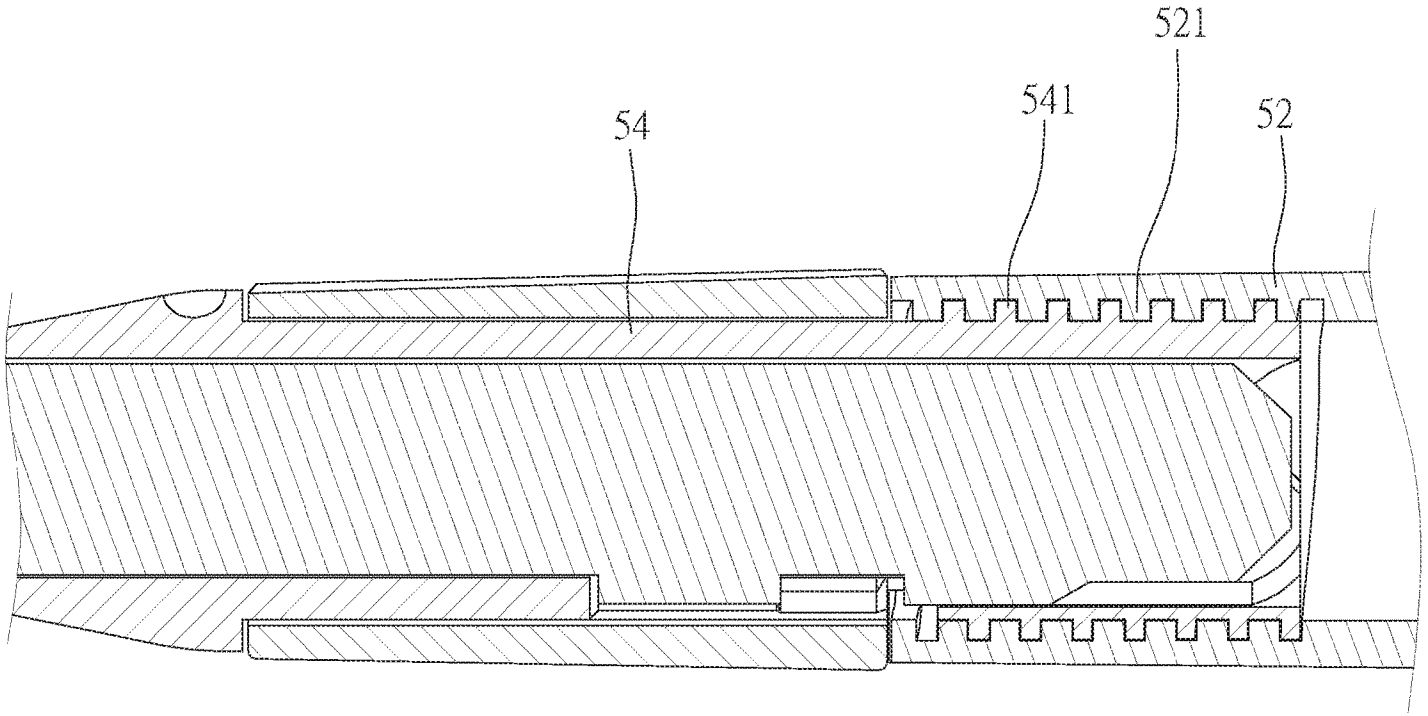
FIG. 13 is a sectional view along the D-D line in FIG. 11.

As shown in FIGS. 11-13, one of a pair of chopsticks 300 of a third embodiment of the present invention includes a first body 50, a locking member 60, and a second body 70.

The first body 50 is elongated, and includes a stick 52, which is a polygonal tube, and a securing member 54. The difference between the third embodiment and the aforementioned embodiments is that, an inner wall of the stick 52 has an internal threaded section 521; the securing member 54 is a round short tube, and an outer wall thereof has an external threaded section 541. The securing member 54 could be fixed by screwing the external threaded section 541 thereof with the internal threaded section 521 of the stick 52 (as shown in FIG. 13).

To assemble the pair of chopsticks 100 of the first embodiment, a plurality of screws are required to be screwed into the securing member 12 and the stick 11. On the contrary, the securing member 54 of one of the chopsticks 300 of the third embodiment could be fixed through the external threaded section 541 and the internal threaded section 521 on the stick 52, which is much easier for assembling, and the manufacturing process could be further facilitated.

In conclusion, the present invention does have the following advantages and efficiencies:

1. A size of the chopsticks could be changed by simply moving the position of the second body. When the second body is received in the storage space, the second body could be prevented from being contaminated by the air outside, and the chopsticks would become more portable.
2. The position of the locking portion in the positioning slot could be changed by simply rotating the locking member, wherein the protrusion of the second body would be blocked from leaving the positioning slot when each of the locking portions is in the corresponding main slot section, which could achieve an effect of positioning while using the chopsticks.
3. The stick of the present invention is a hollow polygonal tube. Therefore the chopsticks would not roll and fall easily from the table.
4. The second body could be taken out easily for cleaning after opening the cover of the chopsticks of the present invention.
5. The second body of the present invention is coated with the silver layer, which prevents bacteria from growing on the second body even if it's exposed to air.

It must be pointed out that the embodiments described above are only some preferred embodiments of the present invention. All equivalent structures which employ the concepts disclosed in this specification and the appended claims should fall within the scope of the present invention.

What is claimed is:

1. A chopstick of a pair of chopsticks; comprising:

a first body, which is elongated, and has a storage space inside, wherein an end of the first body has an opening communicating with the storage space; the first body has at least one positioning slot provided on a wall of the storage space thereof, each of which has a main slot section;

a second body, which is elongated, and is completely or partly receivable in the storage space through the opening of the first body, wherein the second body has at least one protrusion provided on an outer wall thereof; the at least one protrusion enters the main slot section of the at least one positioning slot when the second body is at a first position in the storage space;

a locking member, which has a locking portion, and is engaged with the first body, wherein the locking member is controllable to make the locking portion enter the main slot section of one of the at least one positioning slot to prevent one of the at least one protrusion therein from leaving said main slot section.

2. The chopstick of claim 1, wherein each of the at least one positioning slot has a subsidiary slot section communicating with the main slot section; the locking member is controllable to move the locking portion into the subsidiary slot section; when the locking portion is in the subsidiary slot section, the locking portion no longer blocks the corresponding one of at least one protrusions of the second body from leaving the main slot section of the corresponding one of the at least one positioning slot, whereby the second body is controllable to be moved to a second position in the storage space, wherein when the second body is at the second position, the second body is completely received in the storage space.

3. The chopstick of claim 2, wherein the first body has a positioning protrusion provided on an outer wall thereof; and the locking member is tubular and rotatably fits around the first body; and wherein the locking member has a positioning portion provided on an inner wall thereof to correspond to the positioning protrusion of the first body, whereby the locking member is positioned on the first body through the positioning portion of the locking member and the positioning protrusion of the first body.

4. The chopstick of claim 3, wherein the first body has a circular groove and a ring provided in the circular groove, and the positioning protrusion is on an outer wall of the circular groove; and the positioning portion of the locking member has a first positioning hole and a second positioning hole; when the positioning protrusion enters the first positioning hole, the locking portion enters the subsidiary slot section of one of the at least one positioning slot; when the positioning protrusion enters the second positioning hole, the locking portion enters the main slot section of one of the at least one positioning slot.

5. The chopstick of claim 4, wherein the first body has a bore provided in the circular groove, and the bore runs through the outer wall of the first body; and wherein the ring has two opposite ends which are not connected to each other, and each of the ends has a reversed section entering the bore, whereby the ring is positioned in the circular groove and the ring is not rotatable.

6. The chopstick of claim 4, wherein the first body comprises a stick and a securing member, wherein the stick and the securing member are tubular, and are engaged with each other such that the securing member interior communicates with the stick interior to form the storage space, and the opening is provided at an end of the securing member; the at least one positioning slot and the circular groove are formed on the securing member.

7. The chopstick of claim 6, wherein the main slot section and the subsidiary slot section of each of the at least one positioning slot are open at another end of the securing member, and are parallel to each other; a length of the main slot section is greater than a length of the subsidiary slot section.

8. The chopstick of claim 1, wherein the first body has an opening at another end thereof, and the first body further comprises a cover to seal the opening at the another end of the first body.

* * * * *